US006494318B1

(12) United States Patent
Focke et al.

(10) Patent No.: US 6,494,318 B1
(45) Date of Patent: Dec. 17, 2002

(54) CIGARETTE PACKET

(75) Inventors: Heinz Focke, Verden (DE); Irmin Steinkamp, Seevetal (DE)

(73) Assignee: Focke & Co. (GmbH & Co.), Verden (DE)

( * ) Notice: Subject to any disclaimer, the term of this patent is extended or adjusted under 35 U.S.C. 154(b) by 0 days.

(21) Appl. No.: 09/763,205

(22) PCT Filed: Jul. 31, 1999

(86) PCT No.: PCT/EP99/05552

§ 371 (c)(1),
(2), (4) Date: Feb. 20, 2001

(87) PCT Pub. No.: WO00/10877

PCT Pub. Date: Mar. 2, 2000

(30) Foreign Application Priority Data

Aug. 19, 1998 (DE) ..... 198 37 469

(51) Int. Cl.[7] ..... A24F 15/12
(52) U.S. Cl. ..... 206/273; 206/271
(58) Field of Search ..... 206/259, 264, 206/271, 273; 229/87.13

(56) References Cited

U.S. PATENT DOCUMENTS 3,089,632 A 5/1963 Bartolucci
4,267,958 A * 5/1981 Focke et al. ..... 229/146
4,508,218 A 4/1985 Focke
4,589,545 A 5/1986 Choe
5,762,186 A 6/1998 Bretthauer
6,244,435 B1 * 6/2001 Cho ..... 206/264

FOREIGN PATENT DOCUMENTS

| | | |
|---|---|---|
| DE | 569833 | 3/1931 |
| DE | 25 36 606 | 2/1977 |
| DE | 195 44 205 | 6/1996 |
| DE | 298 09 572 | 9/1998 |

* cited by examiner

*Primary Examiner*—David T. Fidei
(74) *Attorney, Agent, or Firm*—Sughrue Mion, PLLC

(57) ABSTRACT

In configuring soft packs for cigarettes from a single (-piece) blank, firstly, in the region of a base wall, a material reinforcement is formed by double-layered arrangement of the blank. In order to protect the cigarettes against glue being transferred during gluing of the folding tabs of the base wall, a covering tab is arranged on the inside, above the base wall. An extended base corner tab serves here as a covering. In addition, in the region adjacent to an end wall (17), a multi-layered material strip is formed by a Z-shaped fold. In the region of overlap of the material strip on a side wall (13), at least one cutout is arranged in one layer, said cutout ensuring a correct closed position of the layers in this region.

9 Claims, 3 Drawing Sheets

Fig. I
II
III
10
11
12
13
14
15
17
18
19
20
21
22
27
33
34
35
36
42

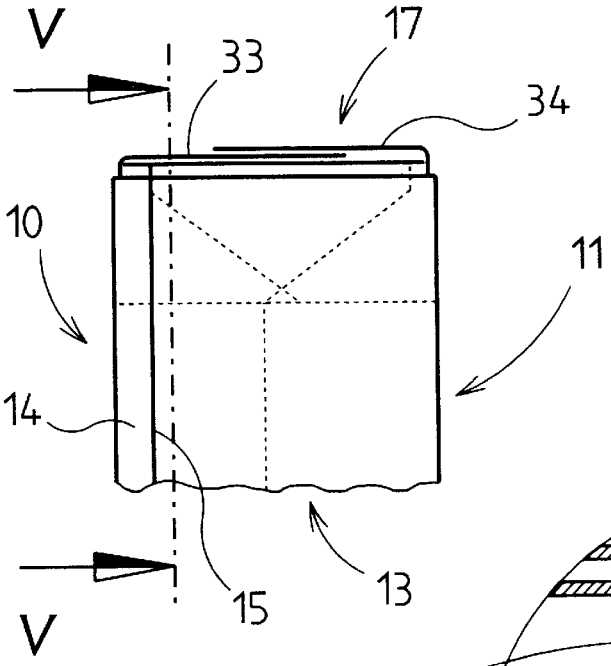
Fig.4
Fig.6
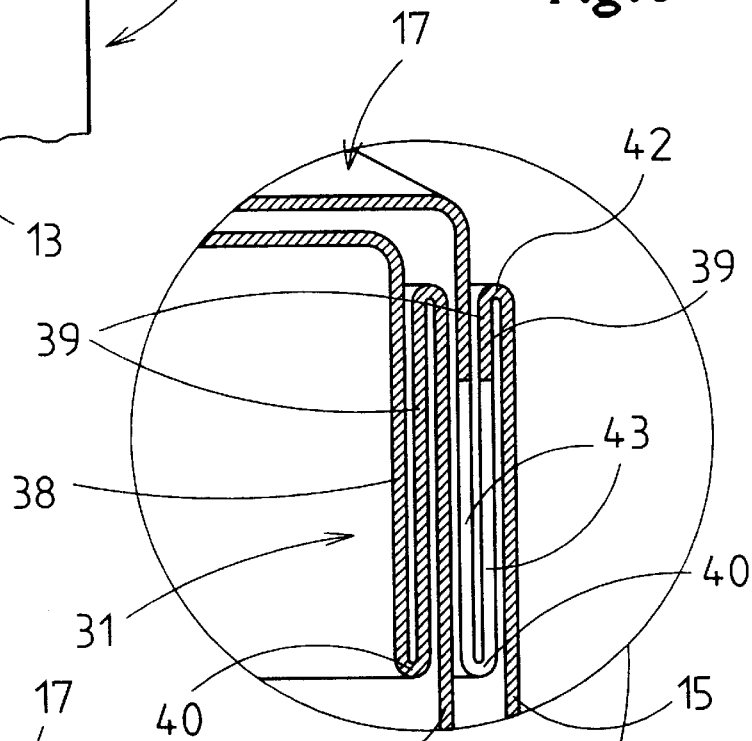
Fig.5
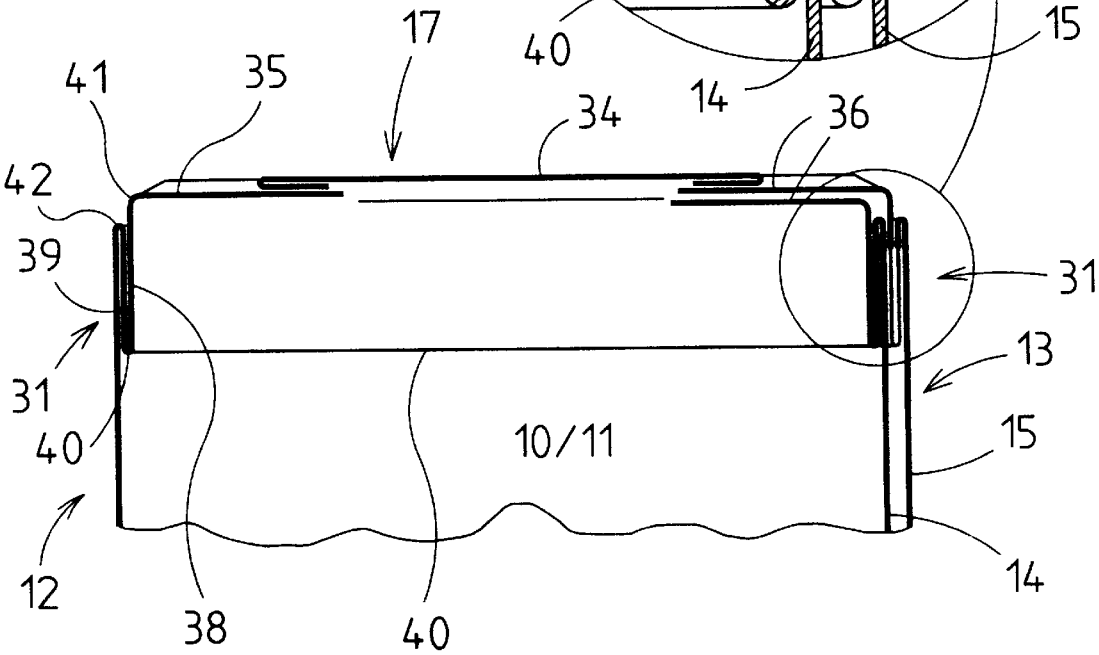

CIGARETTE PACKET

BACKGROUND OF THE INVENTION

The invention relates to a pack for tobacco products, in particular cigarettes, comprising at least one blank which encloses the pack contents and is made of foldable packaging material, such as paper, cardboard or the like, folding tabs of the blank, in particular base folding tabs, (partially) overlapping one another and being connected to one another by glue, and, in addition, a Z-fold of the blank being formed adjacent to a (top) end wall and/or adjacent to a (bottom) base wall.

The invention primarily concerns a modified design of cigarette packs of the soft-carton type, namely preferably comprising a single blank made of paper or comparable packaging material. In order to increase the dimensional stability of such a pack, the latter is provided, at least in a region adjacent to an end wall, with an encircling multiple fold, namely, in particular, a Z-fold (U.S. Pat. No. 4,508, 218). In addition, it is possible for such a cigarette pack to be provided, in the region of a base wall, with material reinforcements, namely a double-layered material strip from which correspondingly double-layered base folding tabs of the base wall are formed (U.S. Pat. No. 5,762,186).

SUMMARY OF THE INVENTION

The invention deals with improvements, in particular to cigarette packs of the abovementioned designs.

The object of the invention is to configure packs of the abovementioned and similar designs so as to ensure an improvement in the outer appearance and improved quality assurance for the pack contents.

In order to achieve this object, the pack according to the invention is characterized in that, between, on the one hand, folding tabs which are connected to one another by glue and, on the other hand, the pack contents, a covering tab is arranged in order to protect against glue being transferred onto the pack contents.

The invention is based on the finding that the gluing of folding tabs of the pack, in particular the gluing of base folding tabs of a base wall, holds the risk of particles of glue being transferred onto the pack contents, in particular onto end regions of the cigarettes adjacent to the base wall of the pack. The covering tab according to the invention protects the end surfaces of the cigarettes against glue being transferred.

Expediently, the covering tab, in the region of the base wall, is part of the blank, that is to say is connected thereto, to be precise preferably as an extension and/or supplement or attachment of a base corner tab which is usually positioned on the inside. Said base corner tab is a continuation of one of the narrow, upright side walls of the pack.

With a pack analogous to U.S. Pat. No. 5,762,186, the invention proceeds such that the covering tab is part of the double-layered material strip in the region of the base wall, but is not involved in reinforcing the pack in this region. Rather, corresponding punch cuts provide a base corner tab, of which the length corresponds to the width of the material strip which is to be folded in a double-layered manner. With the pack in the finished state, said extended base corner tab butts against the inside of the base wall and forms the covering tab.

In the case of a Z-fold formed, in particular, adjacent to the end wall, a plurality of layers may be produced in the region of an overlap of side tabs for forming a side wall on account of overlapping. According to the invention, in the region of the Z-fold and/or the overlapping of the same, a cutout is provided at least in the region of one of the layers and creates a local, border-side layer reduction. The layers are expediently connected by glue in this region, with the result that correct formation of the pack is ensured.

BRIEF DESCRIPTION OF THE DRAWINGS

Further specifics regarding the configuration and production of such (cigarette) packs are explained hereinbelow, with reference to the drawings, in which:

FIG. 1 shows a perspective illustration of the modified cigarette pack of the soft-carton type, FIG. 4 shows a side view of a top, end-side region of a pack of the soft-carton type, FIG. 5 shows a vertical section of FIG. 4 along section plane V—V, FIG. 6 shows a vastly enlarged detail from FIG. 5.

Figures 2, 3:
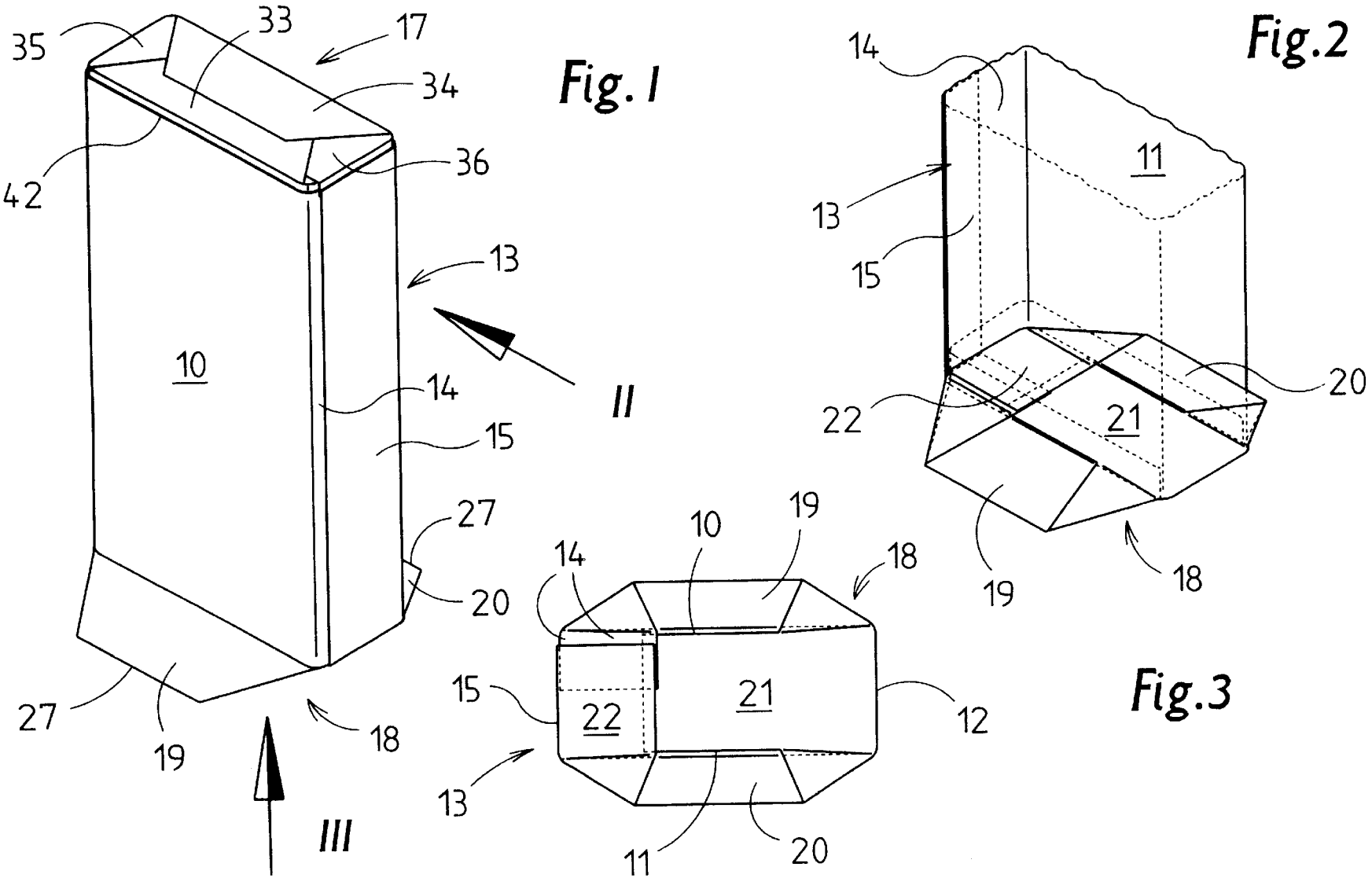
FIG. 2 shows the pack according to FIG. 1 with a base wall being viewed obliquely from beneath.
FIG. 3 shows the base wall in a bottom view in accordance with arrow III in FIG. 1.

The specifics illustrated in the drawings relate to further developments and improvements of (cigarette) packs in particular designed in accordance with U.S. Pat. No. 4,508, 218 and U.S. Pat. No. 5,762,186.

Figure 8:
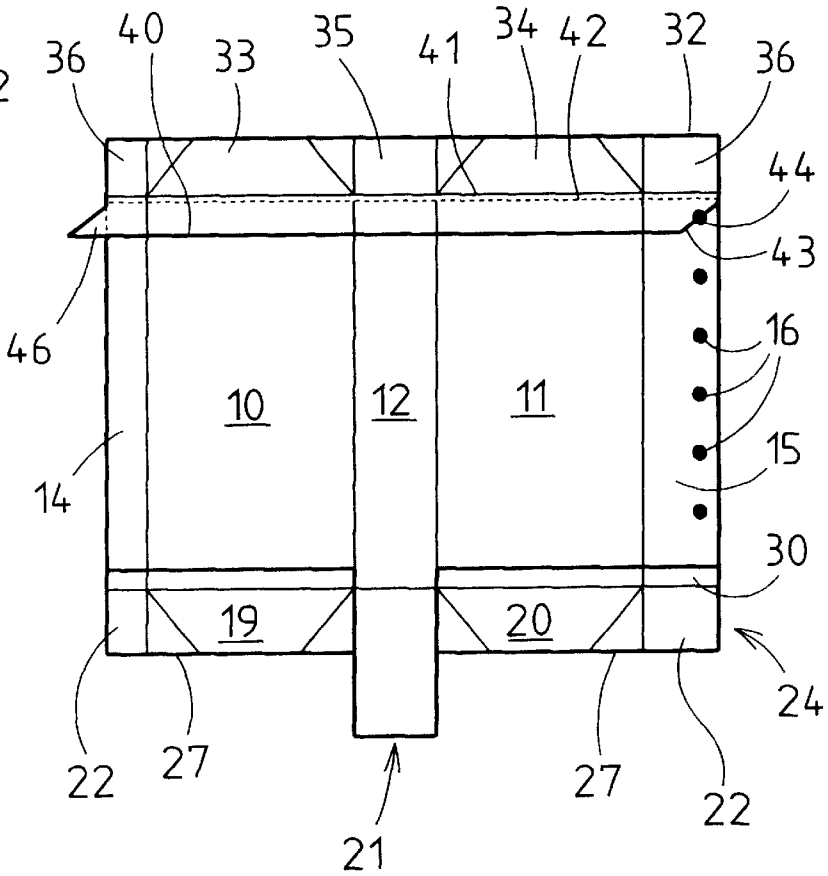
FIG. 8 shows the blank according to FIG. 7 in an intermediate folding position.
Figure 7:
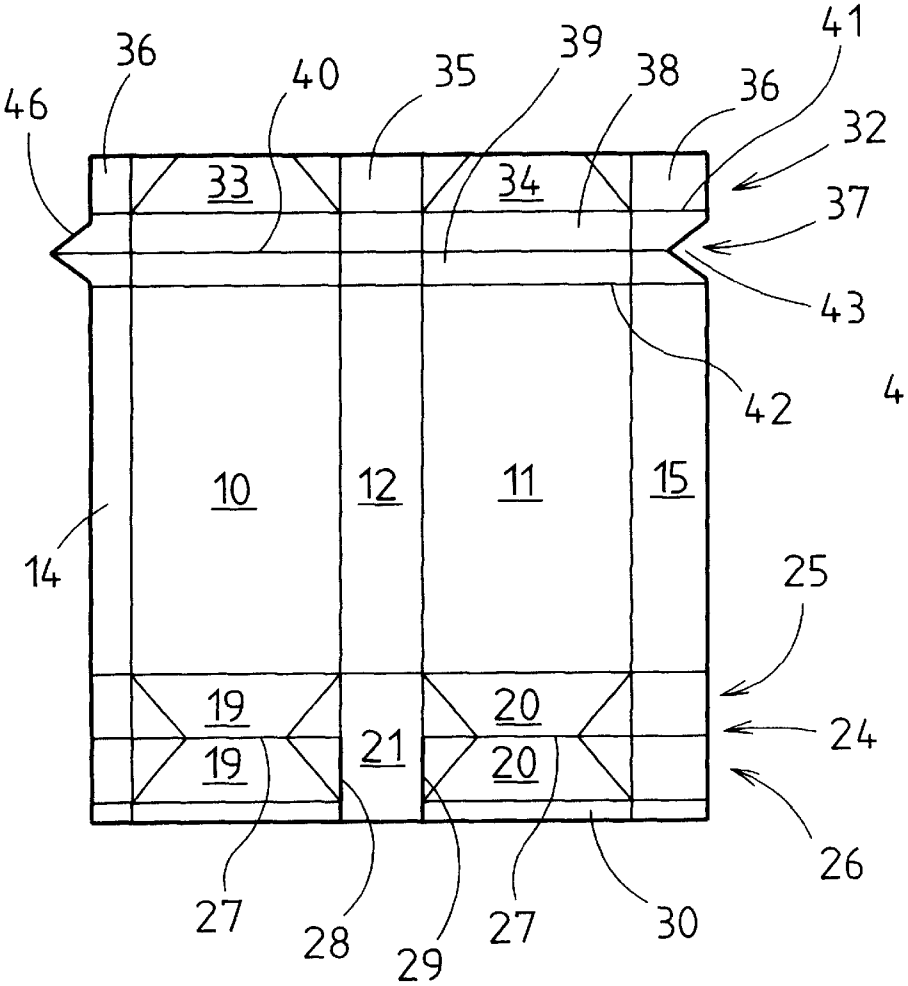
FIG. 7 shows a blank for a pack according to FIGS. 1 to 6 in the spread-out state.

The modified-design (cigarette) pack of the soft-carton type illustrated in perspective in FIG. 1 comprises one single-piece blank (FIGS. 7 and 8). The rectangular blank encloses the pack contents (a group of cigarettes) so as to produce the front wall 10, rear wall 11 and side walls 12, 13. The side wall 13 is formed from two border-side side tabs 14, 15 which partially overlap one another, the wider side tab being located on the outside and overlapping virtually the entire width of the side wall 13. The side tabs 14, 15 are connected to one another by adhesive bonding, in the present example by a plurality of spots of glue 16.

At the top, the blank forms an end wall 17. A base wall 18 is located opposite. The end wall 17 and base wall 18 are formed by a plurality of folding tabs which partially overlap one another. The base wall 18 comprises base folding tabs, namely base longitudinal tabs 19 and 20 and base corner tabs 21, 22. The respectively trapezoidal base longitudinal tabs 19, 20 are connected to the front wall 10, on the one hand, and the rear wall 11, on the other hand. The narrower base corner tabs 21, 22 are connected to the side wall 12, on the one hand, and the side wall 13, on the other hand, or are continuations of the same. The base corner tabs 21, 22 form the inside of the base wall 18, while the base longitudinal tabs 19, 20 are located on the outside. The base longitudinal tabs 19, 20 are connected to one another by adhesive bonding, for example by spots of glue or the like.

A base-side region of the blank or of the pack, namely a folding strip 24, is of double-layered formation. The folding strip 24 comprises two sub-strips 25, 26. The outer sub-strip 26, which is formed on the free border, is folded over along a folding line 27 in order to form the double-layered folding strip 24. The base tabs described are formed from the double-layered folding strip 24.

A covering tab is formed on the inside of the base wall 18, to be precise between the base wall 18 and the pack contents.

The covering tab protects the pack contents against particles of glue being transferred during the adhesive bonding of base folding tabs.

In the exemplary embodiment shown, the covering tab is formed by a base tab, to be precise by the base corner tab 21, which is connected to the side wall 12. For this purpose, the base corner tab 21 is not of double-layered formation. Rather, the base corner tab 21 remains the length predetermined by the width of the folding strip 24, that is to say it is essentially double the length of the base corner tab 22. The blank is prepared by punch lines 28, 29 for this purpose. These extend on the lateral boundaries of the base corner tab 21, to be precise in the region of the folding strip 24, that is to say up to the folding line 27. The regions of the sub-strip 26 may thus be folded over in order to form the base longitudinal tabs 19, 20 and the base corner tabs 22, while the base corner tab 21 remains in the non-folded state and is thus correspondingly longer. In the present exemplary embodiment, an additional length is obtained by way of a border strip 30 provided on the free side of the folding strip 24. With the pack in the finished state, said border strip extends as an inner reinforcement in the region of the front wall 10, rear wall 11 and side walls 12, 13 (FIG. 2).

The base corner tab 21, which is dimensioned correspondingly in the longitudinal direction of the side wall 12, extends along the inside of the base wall 18 as far as the opposite base corner tab 22 or beyond the latter (FIGS. 2 and 3). Accordingly, the pack contents are covered over the entire surface area by the base corner tabs 21, 22 in relation to the externally abutting base longitudinal tabs 19, 20. Using a method analogous to that used for the end wall 17, said base longitudinal tabs are folded and connected to one another. The gluing of the base folding tabs, namely the base longitudinal tabs 19, 20, expediently takes place in a position according to FIGS. 2 and 3. The pack contents, namely the facing ends of the cigarettes, are covered throughout, namely by the single-layered base corner tab 21, on the one hand, and by the adjoining base corner tab 22, on the other hand.

Another special feature of the invention likewise relates to the configuration of the pack in the region of the multi-layered formation of the blank. In the present exemplary embodiment, this is an encircling multi-layered material strip 31 adjacent to the end wall 17 and/or directly beneath the same. Said material strip is formed as a Z-fold.

For this purpose, the blank (FIG. 7) is provided, in an end-side region, with a folding strip 32 which serves for forming end folding tabs, in a manner analogous to the configuration of the base wall 18. This thus relates to the formation of end longitudinal tabs 33, 34 and the narrower end corner tabs 35 and 36. The end corner tab 36 is of partially double-layered formation, namely in a manner analogous to the side wall 13.

An additional material strip, namely a Z-fold strip 37, is formed between the folding strip 32 and the region with the front wall 10, rear wall 11, etc. Said Z-fold strip comprises two sub-strips, namely for legs 38, 39 of the Z-fold. The strip-like legs 38, 39 are separated off from one another by a Z-fold edge 40 and from the folding strip 32 by a folding edge 41 and from the front wall 10, rear wall 11, etc. by a further folding edge 42. Said edges each form deflecting edges of the material when the Z-fold is in the finished state (FIG. 5).

In the region of the side wall 13, the configuration of the material strip 31 results in an accumulation of material layers (FIG. 6). This may result in undesired opening of the fold in this region. In order to counter this effect, material layers are removed from the overlap region, with the result that the overall number of the overlapping layers is locally reduced. For this purpose, preferably inner layers, that is to say layers which are covered on the outside, are provided with cutouts, holes, punched-out portions or the like.

In the present exemplary embodiment, a cutout 43 is arranged on the border side in the region of the Z-fold strip 37, the cutout being open in the direction of the free border. The cutout is of V-shaped formation and extends more or less centrally in the region of the Z-fold strip 37, that is to say on both sides of the Z-fold edge 40. During the production of the pack, first of all the Z-fold is formed in the region of the otherwise planar blank (FIG. 8). Thereafter, the pack contents are wrapped in the thus prepared blank, the material overlapping being produced in the region of the side wall 13. The cutout 43 is arranged in that region of the Z-fold strip 37 which is directed toward the (outer) side tab 15. By way of the inner Z-fold (FIG. 6), the cutout 43, when the pack is in the finished state, is overlapped on the outside by a top region of the side tab 15. Beneath the side tab 14, the configuration and arrangement of the cutout 43 gives a local material and/or layer reduction, to be precise in the region of the legs 38 and 39.

A particularly correct and durable connection in the region of the overlap of the ends of the multi-layered material strip 31 is provided when, in the region of the cutout 43 provided, material layers are connected to one another by adhesive bonding. In the present example, a spot of glue 44 is positioned in the region of the cutout 43. The (outer) side tab 15 is thus connected directly to the inner side tab 14, through the cutout 43. In the exemplary embodiment shown (FIG. 8), the arrangement of the spot of glue 44 is selected such that the latter is positioned centrally in relation to a (double) edge 45 which bounds the cutout 43. By way of a spot of glue 44, at the same time, the outer side tab 15 is thus also connected to the facing leg 39 of the Z-fold strip 37.

The blanks described are expediently divided off from a continuous material web by transversely directed severing cuts, the Z-fold strip 37 expediently extending in the longitudinal direction of the web. The cutout 43 in this case is provided by or with a transversely directed severing cut for the blanks, by virtue of corresponding configuration of a severing cutter. In the respectively following blank, this produces a protrusion or a tongue 46 in the form of the cutout 43 and in continuation of the Z-fold strip 37. This tongue 46 disappears to the inside when the pack is in the finished state.

List of Designations

10 Front wall 45 edge
11 Rear wall 46 tongue
12 Side wall
13 Side wall
14 Side tab
15 Side tab
16 Spot of glue
17 End wall
18 Base wall
19 Base longitudinal tab
20 Base longitudinal tab
21 Base corner tab
22 Base corner tab
24 Folding strip
25 Sub-strip
26 Sub-strip

27 Folding line
28 Punch line
29 Punch line
30 Border strip
31 Material strip
32 Folding strip
33 End longitudinal tab
34 End longitudinal tab
35 End corner tab
36 End corner tab
37 Z-fold strip
38 Leg
39 Leg
40 Z-fold edge
41 Folding edge
42 Folding edge
43 Cutout
44 Spot of glue
45 Edge
46 Tongue

What is claimed is:

1. A pack for tobacco products which comprises at least one blank which encloses pack contents and is made of foldable packaging material for the formation of a pack front wall (10), a pack rear wall (11), pack side walls (12, 13) and a pack lower base wall (18), wherein:

a) the base wall (18) comprises a plurality of partially overlapping folding tabs, with two base corner tabs (21, 22) lying on an inner side of the base wall and connected to respective ones of the side walls (12, 13), and with base longitudinal tabs (19, 20) which are connected to the front wall (10) and rear wall (11), respectively, and which cover the base corner tabs (21, 22) on an outside of the pack;

b) the partially overlapping base longitudinal tabs (19, 20) are connected to each other by an adhesive; and c) arranged on the inner side of the base wall (18), between the base wall and the pack contents, is a covering tab which extends across the base wall (18).

2. The pack according to claim 1, wherein the covering tab is part of the blank and is an extension of one (21) of the base corner tabs, said extension extending into a region of the other, opposite one of the base corner tabs and together therewith forming a continuous covering on a top side of the base wall (18).

3. The pack according to claim 1, wherein:

a) said folding tabs of the base wall (18) are formed from a folded strip (24) of the blank, which folded strip has been folded into a double layer such that at least the base longitudinal tabs (19, 20) are double-layered; and b) said one base corner tab (21), for forming the covering tab located between the pack contents and base wall (18), is non-folded or single-layered such that said one base corner tab (21) has a length corresponding to a width of the folded strip (24) prior to folding thereof.

4. The pack according to claim 3, wherein:

a) the folded strip (24) comprises two folded sub-strips (25, 26);

b) said one base corner tab (21), for forming the covering tab, extends as an extension of one of said side walls (12) which lies between the front wall (10) and the rear wall (11); and c) in a region of an outer marginal one (26) of said sub-strips, said one base corner tab (21) is partitioned off, from adjacent regions of said one sub-strip (26),by punch lines (27, 28) in the width of the sub-strip (26).

5. A pack for tobacco products which comprises at least one blank which encloses pack contents and is made of foldable packaging material for the formation of a pack front wall (10), a pack rear wall (11), pack side walls (12, 13) a pack end wall (17) and a base wall (18), wherein:

a) adjacent to the top end wall (17) and/or adjacent to the lower base wall (18), there is a circumferential material strip (31) made up of a plurality of layers of the blank;

b) the material strip (31) is configured as a Z-fold strip by Z-shaped folding of the blank;

c) one (13) of said side walls comprises partially overlapping folding tabs in the form of an inner side tab (14) and an outer side tab (15);

d) said inner and outer side tabs (14, 15) are connected to each other by adhesive bonding;

e) the material strip (31) extends in a region of said one side wall (13) and forms an overlap;

f) at least one of said layers of the material strip (31) is provided with a cutout (43) in a region of the overlap; and g) the cutout (43) is formed at a free edge of an inner layer or of an inner leg (39) of said material strip (31) and is covered by an outer layer of the blank or of the material strip (31).

6. The pack according to claim 5, the cutout (43) is open in a, direction of a free edge of the blank and is formed by a U-shaped or V-shaped punched portion.

7. The pack according to claim 5, wherein:

a) the cutout (43) extends in a region of at least two of said layers of the material strip (31), namely in a region of two legs (38, 39) of the Z-fold strip (37);

b) the cutout (43) is made in a region of said outer side tab (15); and c) the cutout (43) or the two legs (38, 39) with the cutout are covered on an outer side by a material layer in the form of the side tab (15).

8. The pack according to claim 5, wherein the outer side tab (15) and the inner side tab (14) are overlapping and are connected to each other by a glue bead (44) in a region of the cutout (43).

9. The pack according to claim 2, wherein:

a) said folding tabs of the base wall (18) are formed from a folded strip (24) of the blank, which folded strip has been folded into a double layer such that at least the base longitudinal tabs (19, 20) are double-layered; and b) said one base corner tab (21), for forming the covering tab located between the pack contents and base wall (18), is non-folded or single-layered such that said one base corner tab (21) has a length corresponding to a width of the folded strip (24) prior to folding thereof.

* * * * *